US011441228B2

(12) United States Patent
Miyamoto

(10) Patent No.: US 11,441,228 B2
(45) Date of Patent: Sep. 13, 2022

(54) THERMAL SPRAY POWDER

(71) Applicant: TOYOTA JIDOSHA KABUSHIKI KAISHA, Toyota (JP)

(72) Inventor: Noritaka Miyamoto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 457 days.

(21) Appl. No.: 16/697,978

(22) Filed: Nov. 27, 2019

(65) Prior Publication Data

US 2020/0199760 A1 Jun. 25, 2020

(30) Foreign Application Priority Data

Dec. 20, 2018 (JP) ..... JP2018-238436

(51) Int. Cl.

| | |
|---|---|
| ***B22F 7/00*** | (2006.01) |
| ***C23C 24/08*** | (2006.01) |
| *C09D 5/00* | (2006.01) |
| *C09D 5/10* | (2006.01) |
| *C23C 16/00* | (2006.01) |
| *C23C 18/00* | (2006.01) |

(52) U.S. Cl.
CPC ..... *C23C 24/087* (2013.01)

(58) Field of Classification Search
USPC ..... 106/1.05
See application file for complete search history.

(56) References Cited

U.S. PATENT DOCUMENTS

| | | | | |
|---|---|---|---|---|
| 3,655,425 | A * | 4/1972 | Longo | C23C 4/06 428/404 |
| 7,052,527 | B2 * | 5/2006 | Hajmrle | B22F 1/17 428/688 |
| 2005/0287390 | A1 * | 12/2005 | Hajmrle | B22F 1/17 427/446 |
| 2007/0216107 | A1 | 9/2007 | Freling | |
| 2017/0283932 | A1 | 10/2017 | Miyamoto et al. | |
| 2018/0258539 | A1 * | 9/2018 | Wilson | C23C 24/04 |
| 2018/0298480 | A1 | 10/2018 | Miyamoto | |

FOREIGN PATENT DOCUMENTS

| | | | | |
|---|---|---|---|---|
| DE | 102018107412 | A1 * | 10/2018 | C22C 19/058 |
| DE | 102018107412 | A1 | 10/2018 | |
| JP | 2007-247063 | A | 9/2007 | |
| JP | 2017-179542 | A | 10/2017 | |
| JP | 2018-178187 | A | 11/2018 | |

* cited by examiner

*Primary Examiner* — James E McDonough
(74) *Attorney, Agent, or Firm* — Sughrue Mion, PLLC

(57) ABSTRACT

A thermal spray powder according to the present disclosure is a thermal spray powder which is used to form a thermal spray film having a characteristic of abradability, the thermal spray powder includes Ni alloy particles, solid lubricant particles, and aluminum flakes, the content of oxygen in the aluminum flakes is within a range of 0.29 mass % to 4.1 mass %, and the coverage of aluminum flakes on the surfaces of the Ni alloy particles is within a range of 60% to 100%.

2 Claims, 9 Drawing Sheets

ALUMINUM FLAKE
AVERAGE PARTICLE SIZE: 30 μm
AVERAGE THICKNESS: 0.5 μm

10μm

ALUMINUM PARTICLE
PARTICLE SIZE: 5 μm~7 μm

10μm

ALUMINUM FLAKE
AVERAGE PARTICLE SIZE: 30 μm
AVERAGE THICKNESS: 0.5 μm

ALUMINUM PARTICLE
PARTICLE SIZE: 5 μm~7 μm

CONTENT OF OXYGEN PRESENT ON SURFACE OF Ni ALLOY PARTICLES IS LARGE

CONTENT OF OXYGEN PRESENT ON SURFACE OF Ni ALLOY PARTICLES IS SMALL

THERMAL SPRAY POWDER

INCORPORATION BY REFERENCE

The disclosure of Japanese Patent Application No. 2018-238436 filed on Dec. 20, 2018 including the specification, drawings and abstract is incorporated herein by reference in its entirety.

BACKGROUND

1. Technical Field

The present disclosure relates to a thermal spray powder suitable for forming a thermal spray film having a characteristic of abradability.

2. Description of Related Art

In the related art, for example, a thermal spray film having a characteristic of abradability by which it can protect other objects by undergoing wear itself (hereinafter abbreviated as a "thermal spray film") has been used for members such as gas turbines and jet engines. In addition, in recent years, in order to improve turbo efficiency in a turbocharger, a thermal spray film for adjusting the gap between a turbine housing on the exhaust side and a turbine wheel has been developed. The thermal spray film is formed by thermally spraying a thermal spray powder using a material selected according to required characteristics.

For thermal spray films, characteristics such as favorable machinability by which the film can be easily cut by another object, for example, erosion resistance that can minimize erosion due to a high-speed gas flow and oxidation resistance, are required. In order to obtain favorable machinability among these characteristics, for example, a method in which solid lubricant particles are incorporated into a thermal spray powder and the machinability of a thermal spray film is improved is used.

Regarding such thermal spray powders, for example, U.S. Pat. No. 7,052,527 describes a thermal spray powder which contains solid lubricant particles such as hexagonal boron nitride (h-BN) in addition to metal particles such as a Ni alloy, and thus can form a thermal spray film having favorable machinability, erosion resistance, oxidation resistance, and the like, and is suitably used for a gas turbine and the like. In addition, Japanese Unexamined Patent Application Publication No. 2007-247063 (JP 2007-247063 A) describes a thermal spray powder which contains metal particles such as a Ni—Cr alloy and solid lubricant particles such as boron nitride (BN) and can form a thermal spray film having abrasion resistance. In addition, Japanese Unexamined Patent Application Publication No. 2017-179542 (JP 2017-179542 A) describes a thermal spray powder which contains Ni—Cr alloy particles and synthetic mica particles and thus can form a thermal spray film that can reduce adhesive wear of another object.

SUMMARY

However, after the thermal spray films that are formed by thermally spraying thermal spray powders described in U.S. Pat. No. 7,052,527, JP 2007-247063 A, and JP 2017-179542 A are used under a high temperature environment, for example, in a turbocharger, metal atoms diffuse between metal particles, and sintering occurs. As a result, the machinability deteriorates. Therefore, in some cases, sufficient machinability could not be ensured after use under a high temperature environment.

The present disclosure has been made in view of the above circumstances, and the present disclosure provides a thermal spray powder that can form a thermal spray film which can secure sufficient machinability after use under a high temperature environment.

In order to address the above problems, the thermal spray powder according to the present disclosure is a thermal spray powder that can form a thermal spray film having the characteristic of abradability, and the thermal spray powder includes Ni alloy particles, solid lubricant particles, and aluminum flakes, the content of oxygen in the aluminum flakes is within a range of 0.29 mass % to 4.1 mass %, and the coverage of aluminum flakes on the surfaces of the Ni alloy particles is within a range of 60% to 100%.

According to the present disclosure, it is possible to form a thermal spray film which can secure sufficient machinability after use under a high temperature environment.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Embodiments of thermal spray powders of the present disclosure (hereinafter abbreviated as "the present embodiment") will be described below.

The thermal spray powder of the present embodiment is a thermal spray powder for forming a thermal spray film having the characteristic of abradability, and the thermal spray powder includes Ni alloy particles, solid lubricant particles, and aluminum flakes, the content of oxygen in the aluminum flakes is within a range of 0.29 mass % to 4.1 mass %, and the coverage of aluminum flakes on the surfaces of the Ni alloy particles is within a range of 60% to 100%.

First, an outline of the thermal spray powder of the present embodiment will be described with reference to the drawings. Here, FIG. 1A is a schematic view showing examples of the thermal spray powder of the present embodiment, and FIG. 1B is a cross-sectional view schematically showing a thermal spray film formed by thermally spraying the thermal spray powder shown in FIG. 1A on a surface of a substrate.

Figure 1A:
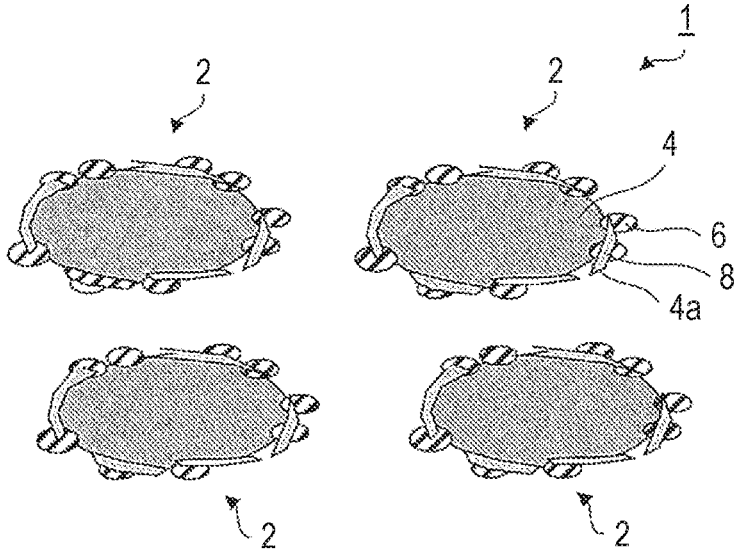
FIG. 1A is a schematic view showing examples of a thermal spray powder of the present embodiment.

As shown in FIG. 1A, a thermal spray powder 1 of an example of the present embodiment includes Ni alloy particles 4, solid lubricant particles 6, and aluminum flakes 8, and is a granulated powder including a large number of granulated particles 2 in which solid lubricant particles 6 and aluminum flakes 8 are adhered to the surfaces 4*a* of Ni alloy particles 4 via a binder resin (not shown). The Ni alloy particles 4 are, for example, particles made of a Ni—Cr—Fe alloy, and the solid lubricant particles 6 are, for example, solid lubricant particles containing hexagonal boron nitride (h-BN) and the like. Some of the aluminum flakes 8 are oxidized and the content of oxygen is within a range of 0.29 mass % to 4.1 mass %. Since the aluminum flakes 8 are in the form of flakes, the coverage of the aluminum flakes 8 on the surfaces 4*a* of the Ni alloy particles 4 becomes as high as 60% to 100%.

Figure 1B:
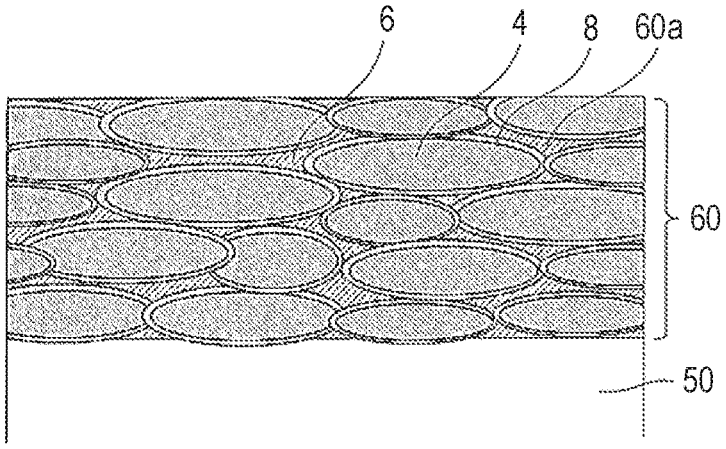
FIG. 1B is a cross-sectional view schematically showing a thermal spray film formed by thermally spraying the thermal spray powder shown in FIG. 1A on a surface of a substrate.

Thus, as shown in FIG. 1B, in a thermal spray film 60 formed by thermally spraying the thermal spray powder 1 on a surface of a substrate 50, in most parts in which Ni alloy particles 4 are connected to each other, the Ni alloy particles 4 are fused to each other via the aluminum flakes 8. Here, solid lubricant particles 6 are filled into gaps 60*a* between Ni alloy particles 4. Since aluminum has high wettability with respect to both Ni alloy particles 4 and solid lubricant particles 6, separation of the Ni alloy particles 4 and the solid lubricant particles 6 during film formation is restricted by the aluminum flakes 8. As a result, the solid lubricant particles 6 are likely to remain in the gaps 60*a*.

Figure 2A:
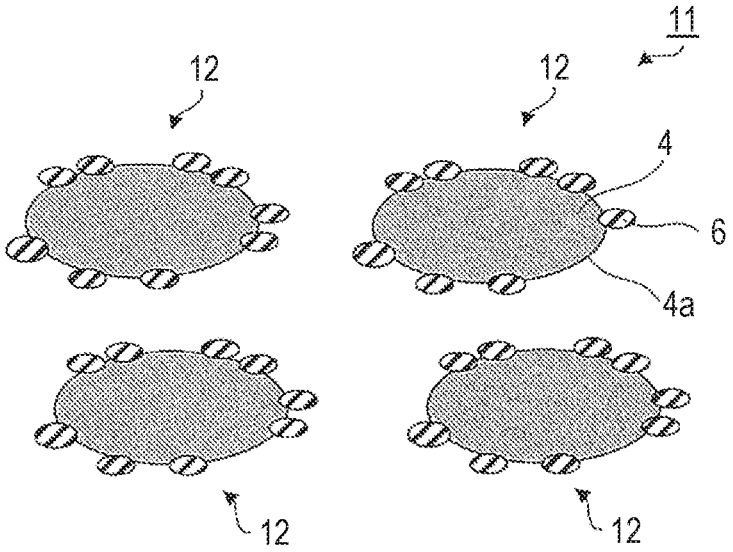
FIG. 2A is a schematic view showing first examples of a thermal spray powder of the related art.
Figure 2B:
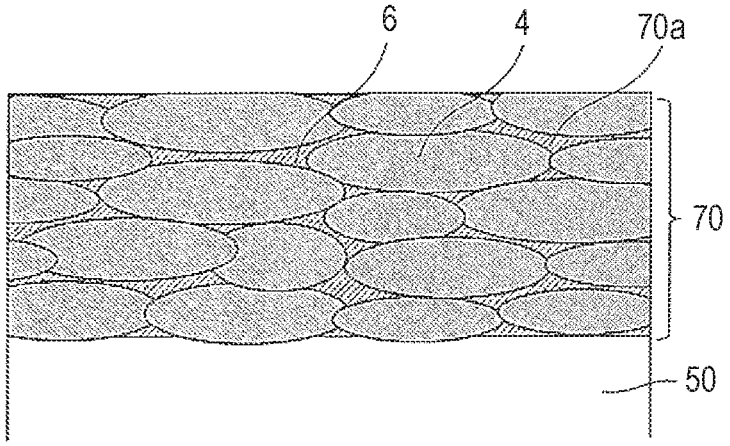
FIG. 2B is a cross-sectional view schematically showing a thermal spray film formed by thermally spraying the thermal spray powder shown in FIG. 2A on a surface of a substrate.
Figure 3A:
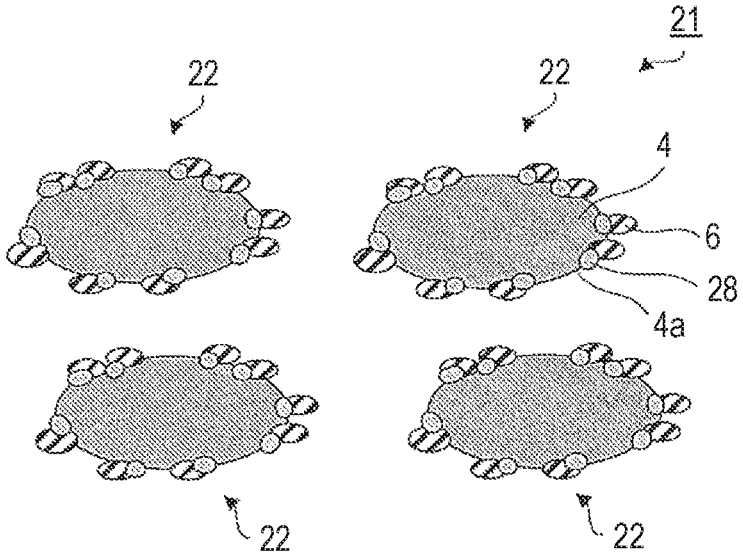
FIG. 3A is a schematic view showing second examples of a thermal spray powder of the related art.
Figure 3B:
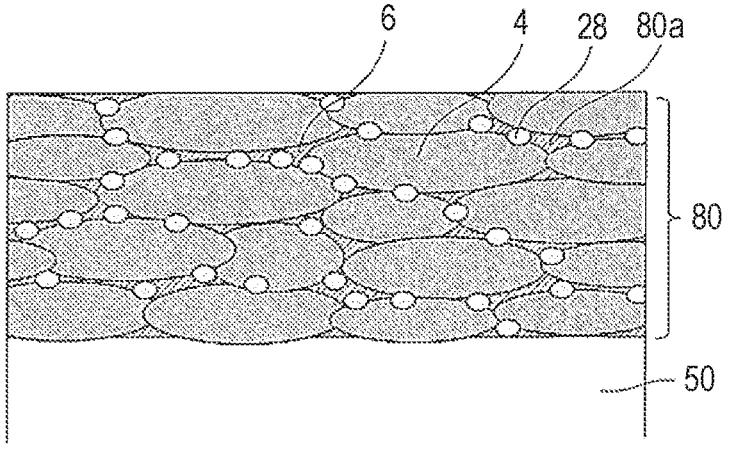
FIG. 3B is a cross-sectional view schematically showing a thermal spray film formed by thermally spraying the thermal spray powder shown in FIG. 3A on a surface of a substrate.
Figure 4:
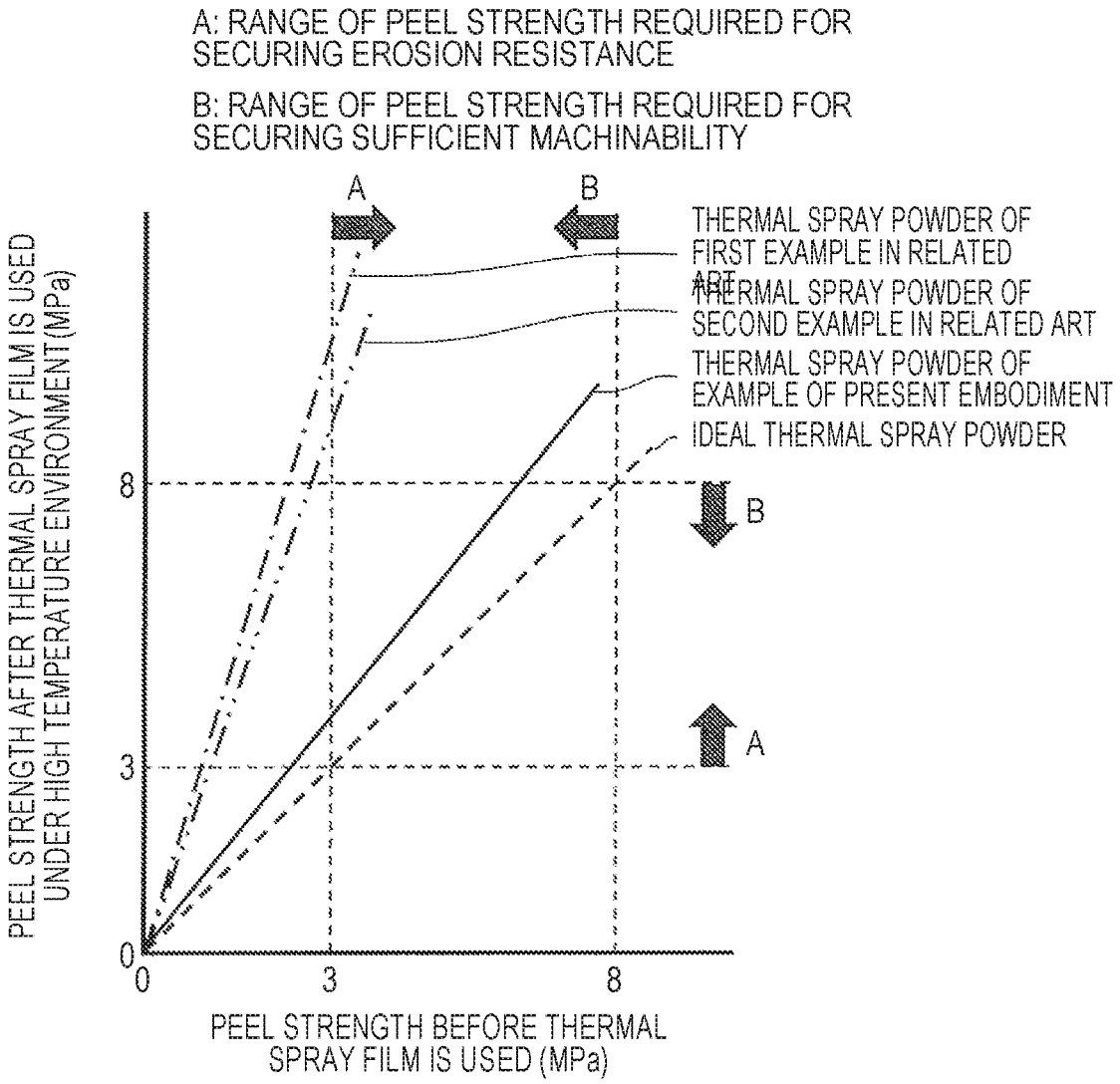
FIG. 4 is a graph schematically showing the peel strength after a thermal spray film is used under a high temperature environment with respect to the peel strength before a thermal spray film is used.

On the other hand, FIG. 2A is a schematic view showing first examples of a thermal spray powder of the related art. FIG. 2B is a cross-sectional view schematically showing a thermal spray film formed by thermally spraying the thermal spray powder shown in FIG. 2A on a surface of a substrate. FIG. 3A is a schematic view showing second examples of a thermal spray powder of the related art. FIG. 3B is a cross-sectional view schematically showing a thermal spray film formed by thermally spraying the thermal spray powder shown in FIG. 3A on a surface of a substrate. In addition, FIG. 4 is a graph schematically showing the peel strength after a thermal spray film is used under a high temperature environment with respect to the peel strength before a thermal spray film is used.

As shown in FIG. 2A, a thermal spray powder 11 of the first example of the related art includes Ni alloy particles 4 and solid lubricant particles 6, and is a granulated powder including a large number of granulated particles 12 in which solid lubricant particles 6 are adhered to the surfaces 4*a* of the Ni alloy particles 4 via a binder resin (not shown). The Ni alloy particles 4 and the solid lubricant particles 6 are the same particles as in the example of the present embodiment.

Thus, as shown in FIG. 2B, in a thermal spray film 70 formed by thermally spraying the thermal spray powder 11 on a surface of the substrate 50, Ni alloy particles 4 are directly fused to each other in all parts in which Ni alloy particles 4 are connected to each other. Therefore, when the thermal spray film 70 is used under a high temperature environment, metal atoms diffuse between Ni alloy particles 4 in all of the connection parts, and sintering occurs, and thereby the bond strength between Ni alloy particles 4 increases. As a result, as indicated by a one dot-dashed line in the graph in FIG. 4, when the peel strength before the thermal spray film 70 is used is 3 MPa or more which is a lower limit at which it is possible to secure erosion resistance by which erosion due to, for example, a high-speed gas flow can be minimized, for example, in a turbocharger, the peel strength after the thermal spray film 70 is used under a high temperature environment exceeds 8 MPa which is an upper limit at which it is possible to secure sufficient machinability, for example, in a turbocharger. Here, solid lubricant particles 6 are filled into gaps 70*a* between Ni alloy particles 4.

As shown in FIG. 3A, a thermal spray powder 21 of a second example of the related art includes Ni alloy particles 4, solid lubricant particles 6, and aluminum particles 28, and is a granulated powder including a large number of granulated particles 22 in which solid lubricant particles 6 and aluminum particles 28 are adhered to the surfaces 4*a* of Ni alloy particles 4 via a binder resin (not shown). The Ni alloy particles 4 and the solid lubricant particles 6 are the same particles as in the example of the present embodiment. Although some of the aluminum particles 28 are oxidized, they have a granular form unlike the aluminum flakes 8 in the example of the present embodiment. Therefore, the coverage of the aluminum particles 28 on the surfaces 4*a* of the Ni alloy particles 4 is 20%, which is lower than the coverage of the aluminum flakes 8 on the surfaces of the Ni alloy particles 4 in the example of the present embodiment.

Thus, as shown in FIG. 3B, in a thermal spray film 80 formed by thermally spraying the thermal spray powder 21 on a surface of the substrate 50, in most parts in which Ni alloy particles 4 are connected to each other, while aluminum particles 28 are interposed between Ni alloy particles 4, the Ni alloy particles 4 are directly fused to each other. Therefore, when the thermal spray film 80 is used under a high temperature environment, there is almost no difference from the thermal spray film 70 shown in FIG. 2B, metal atoms diffuse between Ni alloy particles 4 in most of the connection parts, and sintering occurs, and thereby the bond strength between Ni alloy particles 4 increases. As a result, as indicated by the two-dot-dashed line in the graph in FIG. 4, when the peel strength before the thermal spray film 80 is used is 3 MPa or more, the peel strength after the thermal spray film 80 is used under a high temperature environment exceeds 8 MPa. Here, solid lubricant particles 6 are filled into gaps 80*a* between Ni alloy particles 4, and aluminum particles 28 make it easy for solid lubricant particles 6 to remain in the gaps 80*a*.

On the other hand, in the thermal spray film 60 according to the example of the present embodiment, unlike two examples of the related art, in most parts in which Ni alloy particles 4 are connected to each other, the Ni alloy particles 4 are fused to each other via the aluminum flakes 8. Therefore, when the thermal spray film 60 is used under a high temperature environment, oxygen contained in aluminum flakes 8 restricts diffusion of metal atoms between the Ni alloy particles 4 in most of the connection parts, and the progress of sintering can be curbed. Therefore, it is possible to minimize an increase in the bond strength between Ni alloy particles 4. As a result, as indicated by the solid line in the graph in FIG. 4, even if the peel strength before the thermal spray film 60 is used is 3 MPa or more, the peel strength after the thermal spray film 60 is used under a high temperature environment can be 8 MPa or less. Therefore, in the thermal spray film 60, sufficient machinability can be secured after use under a high temperature environment, for example, in a turbocharger.

As in the example of the present embodiment, the thermal spray powder of the present embodiment includes Ni alloy particles, solid lubricant particles, and aluminum flakes, the content of oxygen of aluminum flakes is within a range of 0.29 mass % to 4.1 mass %, and the coverage of aluminum flakes on the surfaces of the Ni alloy particles is within a range of 60% to 100%. Therefore, in a thermal spray film formed by thermally spraying the thermal spray powder of the present embodiment, in most parts in which Ni alloy particles are connected to each other, the Ni alloy particles are fused to each other via the aluminum flakes. Therefore, when the thermal spray film is used under a high temperature environment, oxygen contained in aluminum flakes restricts diffusion of metal atoms between Ni alloy particles in most of the connection parts, and thus the progress of sintering can be curbed. Therefore, according to the present embodiment, it is possible to form a thermal spray film that can secure sufficient machinability after use under a high temperature environment, for example, in a turbocharger.

Next, the configuration of the thermal spray powder according to the present embodiment will be described in detail.

1. Aluminum Flakes

Aluminum flakes are flaky aluminum which is partially oxidized, and the content of oxygen is within a range of 0.29 mass % to 4.1 mass %.

The shape of aluminum flakes is not particularly limited as long as they are flaky so that the coverage of aluminum flakes on the surfaces of Ni alloy particles can be within a range of 60% to 100% when the contents of Ni alloy particles, solid lubricant particles, and aluminum flakes in the thermal spray powder are set to be within desired ranges. For example, a shape in which the average thickness is within a range of 0.1 μm to 2 μm and the average particle size is within a range of 10 μm to 100 μm is preferable, and a shape in which the average thickness is within a range of 0.3 μm to 1 μm and the average particle size is within a range of 20 μm to 50 μm is particularly preferable.

Here, "average thickness of aluminum flakes" refers to the thickness of an aluminum foil, for example, when aluminum flakes are produced by pulverizing the aluminum foil. In addition, "average particle size of aluminum flakes" refers to the average particle size of aluminum flakes in a planar direction perpendicular to the thickness direction, and refers to, for example, a 50% average particle size (D50) of the equivalent circle diameter obtained from the area of the plane perpendicular to the thickness direction of aluminum flakes. In addition, the average thickness and the average particle size of aluminum flakes can be measured using, for example, a scanning electron microscope (SEM).

The average particle size of aluminum flakes can be adjusted according to pulverization conditions when, for example, aluminum flakes are produced by pulverizing an aluminum foil. In addition, for example, when aluminum flakes are produced by pulverizing an aluminum foil, the thickness of aluminum flakes can be adjusted by the thickness of the aluminum foil.

The content of oxygen in aluminum flakes is not particularly limited as long as it is within the above range, and is preferably within a range of 0.29 mass % to 1 mass %. This is because erosion resistance of the thermal spray film can be secured when use starts, for example, in a turbocharger.

The content of oxygen in aluminum flakes can be measured using an oxygen-nitrogen analyzing device.

An aluminum flake producing method is not particularly limited, and a general method can be used, examples of which include a production method in which an aluminum foil is pulverized using a ball mill or the like.

Regarding a method of adjusting the content of oxygen in aluminum flakes, for example, a method in which the content of oxygen is adjusted by controlling a pulverization time in a method of producing aluminum flakes by pulverizing an aluminum foil may be exemplified.

2. Ni Alloy Particles

Ni alloy particles are particles made of a Ni alloy.

The Ni alloy is not particularly limited, and examples thereof include a Ni—Cr alloy, a Ni—Al alloy, a Ni—Cr—Fe alloy, and a Ni—Cr—Al alloy.

The Ni—Cr alloy is not particularly limited, and a Ni—Cr alloy in which the content of Cr is within a range of 20 mass % to 50 mass % is preferable. This is so that it is possible to improve oxidation resistance of Ni alloy particles. The Ni—Al alloy is not particularly limited, and a Ni—Al alloy in which the content of Al is within a range of 4 mass % to 20 mass % is preferable. The Ni—Cr—Fe alloy is not particularly limited, and a Ni—Cr—Fe alloy in which the content of Cr is within a range of 14 mass % to 18 mass %, and the content of Fe is within a range of 7 mass % to 10 mass % is preferable. The Ni—Cr—Al alloy is not particularly limited, and a Ni—Cr—Al alloy in which the content of Cr is within a range of 18 mass % to 22 mass % and the content of Al is within a range of 6 mass % to 10 mass % is preferable. Here, the content of Ni in such a Ni alloy may be considered as the content of the remainder excluding Cr, Al, and Fe.

The particle size of Ni alloy particles is not particularly limited, and is, for example, preferably within a range of 38 μm to 150 μm, and particularly preferably within a range of 45 μM to 125 μm.

Here, "particle size" refers to a particle size measured using a laser diffraction particle size distribution measuring method, and such a particle size can be obtained by classification according to, for example, JISZ2510.

3. Solid Lubricant Particles

The solid lubricant particles are not particularly limited, and examples thereof include those containing one, two or more selected from among hexagonal boron nitride (h-BN), graphite (C), resins such as polytetrafluoroethylene (PTFE), molybdenum disulfide ($MoS_2$), tungsten disulfide ($WS_2$), and the like, and those containing one, two or more selected from among hexagonal boron nitride, graphite, and resins such as polytetrafluoroethylene are preferable. This is because they have high lubricity.

The particle size of solid lubricant particles is not particularly limited, and is preferably smaller than that of Ni alloy particles. This is so that the entire surfaces of the Ni alloy particles can be covered with solid lubricant particles. The particle size of solid lubricant particles is preferably, for example, within a range of 3 μm to 30 μm, and particularly preferably within a range of 3 μm to 10 μm. This is so that the entire surfaces of Ni alloy particles can be uniformly covered with solid lubricant particles with the content to be described below.

4. Thermal Spray Powder

The thermal spray powder is a thermal spray powder for forming a thermal spray film having the characteristic of abradability, and includes Ni alloy particles, solid lubricant particles, and aluminum flakes, and the coverage of aluminum flakes on the surfaces of Ni alloy particles is within a range of 60% to 100%.

Here, "the coverage of aluminum flakes on the surfaces of Ni alloy particles" refers to a proportion of the area in the region covered with aluminum flakes on the surfaces of Ni alloy particles (expressed as a percentage). The coverage of aluminum flakes on the surfaces of Ni alloy particles can be measured using, for example, a scanning electron microscope (SEM).

The coverage of aluminum flakes on the surfaces of Ni alloy particles is not particularly limited as long as it is within the above range, and is particularly preferably within a range of 60% to 80%. This is because, when the coverage is a lower limit of the range or more, it is possible to curb easy progress of sintering while keeping a high temperature, and when the coverage is an upper limit of the range or less, it is easy to secure the strength required for a thermal spray film.

The content of aluminum flakes in the thermal spray powder is not particularly limited, and is preferably, for example, within a range of 3 mass % to 5 mass %. Since aluminum has high wettability with respect to both Ni alloy particles and solid lubricant particles containing, for example, hexagonal boron nitride, when the thermal spray powder contains aluminum flakes in such a range, it is possible to restrict separation of Ni alloy particles and solid lubricant particles during film formation. Here, when the content of aluminum flakes is too low, it is not possible to expect a sufficient wettability effect of Ni alloy particles and solid lubricant particles according to aluminum flakes in the thermal spray film. On the other hand, when the content of aluminum flakes is too high, the machinability in the thermal spray film deteriorates.

The content of solid lubricant particles in the thermal spray powder is not particularly limited, and is preferably, for example, within a range of 4 mass % to 8 mass %. This is so that it is possible to reduce adhesive wear of the thermal spray film and it is possible to further improve the characteristic of abradability. On the other hand, when the content of solid lubricant particles is too low, sufficient solid lubricity cannot be exhibited and adhesive wear of the thermal spray film easily occurs. In addition to this, since there are fewer solid lubricant particles interposed between Ni alloy particles of the thermal spray film, the number of metal bonds between Ni alloy particles increases. Therefore, the hardness of the thermal spray film increases and the machinability of the thermal spray film deteriorates. On the other hand, when the content of solid lubricant particles is too high, the thermal spray film becomes brittle due to an increase in solid lubricant particles.

The content of Ni alloy particles in the thermal spray powder may be considered as the content of the remainder excluding solid lubricant particles and aluminum flakes. Here, the contents of Ni alloy particles, solid lubricant particles, and aluminum flakes in the thermal spray powder are calculated without consideration of the content of a binder of such as a binder resin added during granulation of the thermal spray powder.

A method of producing a thermal spray powder is not particularly limited, and examples thereof include a producing method in which an alloy powder containing Ni alloy particles, a solid lubricant powder containing solid lubricant particles, and an aluminum powder containing aluminum flakes are mixed together, and the solid lubricant particles and the aluminum flakes are adhered to the surfaces of the Ni alloy particles via a binder of such as a binder resin for granulation. Here, when the thermal spray powder is thermally sprayed, the thermal spray powder may be a powder in which Ni alloy particles, solid lubricant particles, and aluminum flakes are mixed as long as Ni alloy particles and solid lubricant particles, and aluminum flakes that are uniformly mixed can be thermally sprayed. In addition, the thermal spray powder may be compacted according to a cladding method or the like.

5. Other

A thermal spray method for a thermal spray powder is not particularly limited as long as a thermal spray film can be formed, and examples thereof include a gas flame thermal spray method and a plasma thermal spray method. A gas flame thermal spray method is particularly preferable. Compared with other thermal spray methods such as a plasma thermal spray method, it allows the thermal spray powder to be thermally sprayed at a low temperature. Therefore, since more solid lubricant particles can be interposed between Ni alloy particles during thermal spray film formation, the number of metal bonds between Ni alloy particles can be reduced and the machinability of the thermal spray film can be improved.

The thermal spray powder according to the present embodiment will be described below in more detail with reference to examples and comparative examples.

Example 1-1

A Ni alloy powder (gas atomized powder) including Ni alloy particles made of a Ni—Cr—Fe alloy containing Ni: 77 mass %, Cr: 15 mass %, and Fe: 8 mass % and having a particle size of 45 μm to 125 μm was prepared. Next, a solid lubricant material including solid lubricant particles containing hexagonal boron nitride (h-BN) and having a particle size of 3 μm to 10 μm was prepared.

Figure 5A:
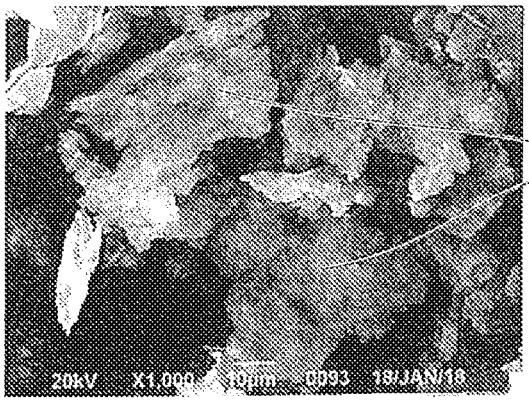
FIG. 5A shows an image obtained by observing aluminum flakes contained in an aluminum powder in an example under a scanning electron microscope (SEM)

Next, an aluminum powder including aluminum flakes having an average thickness of 0.5 μm, an average particle size of 30 μm, and a content of oxygen of 0.29 mass % was prepared. Specifically, an aluminum foil (commercially available from Minalco Co., Ltd.) was pulverized using a ball mill for 10 minutes to prepare an aluminum powder. Here, FIG. 5A shows an image obtained by observing aluminum flakes contained in an aluminum powder in an example under a scanning electron microscope (SEM).

Next, the Ni alloy powder, the solid lubricant material, and the aluminum powder were mixed so that the solid lubricant material: 4.5 mass %, the aluminum powder: 3 mass %, and the NiCr alloy powder: the remainder, and the solid lubricant particles and the aluminum flakes were adhered to surfaces of Ni alloy particles via a binder resin, and a thermal spray powder was produced by granulation.

Next, the thermal spray powder was thermally sprayed on a surface of a substrate and thereby a thermal spray test piece on which a thermal spray film with a film thickness of 0.8 mm was formed was produced. Specifically, the thermal spray powder was thermally sprayed on a surface of a substrate with a width of 50 mm, a length of 50 mm, and a thickness of 5 mm (nickel alloy (Inconel 600)) using a gas flame thermal spray device (commercially available from Oerlikon Metco 6P-II), and thereby a thermal spray film was formed. The gas pressure of gases supplied to the thermal spray gun was oxygen gas: 42 psi, hydrogen gas (fuel gas): 34 psi, and air: 60 psi, and gas flow rates of supply gases were oxygen gas: 461 NLPM, hydrogen gas: 149 NLPM, and air: 110 NLPM. A supply amount of the thermal spray powder supplied to the thermal spray gun during film formation was 90 g/min, a distance from the tip of the thermal spray gun to the substrate was 230 mm, the movement speed of the thermal spray gun was 30 m/min, and the pitch was 6 mm.

Example 1-2

First, a thermal spray powder was produced in the same manner as in Example 1-1 except that an aluminum foil was pulverized for 20 minutes to prepare an aluminum powder including aluminum flakes having a content of oxygen of 0.94 mass %.

Next, in the same manner as in Example 1-1, a thermal spray test piece in which a thermal spray film was formed by thermally spraying the thermal spray powder on a surface of a substrate was produced.

Example 1-3

First, a thermal spray powder was produced in the same manner as in Example 1-1 except that an aluminum foil was pulverized for 50 minutes to prepare an aluminum powder including aluminum flakes having a content of oxygen of 4.1 mass %.

Next, in the same manner as in Example 1-1, a thermal spray test piece in which a thermal spray film was formed by thermally spraying the thermal spray powder on a surface of a substrate was produced.

Comparative Example 1

First, a thermal spray powder was produced in the same manner as in Example 1-1 except that an aluminum foil was pulverized for 160 minutes to prepare an aluminum powder including aluminum flakes having a content of oxygen of 5.0 mass %.

Next, in the same manner as in Example 1-1, a thermal spray test piece in which a thermal spray film was formed by thermally spraying the thermal spray powder on a surface of a substrate was produced.

Example 2-1

First, a thermal spray powder was produced in the same manner as in Example 1-1 except that the NiCr alloy powder, the solid lubricant material, and the aluminum powder were mixed so that the solid lubricant material: 4.5 mass %, the aluminum powder: 4 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Example 2-2

First, a thermal spray powder was produced in the same manner as in Example 1-2 except that the NiCr alloy powder, the solid lubricant material, and the aluminum powder were mixed so that the solid lubricant material: 4.5 mass %, the aluminum powder: 4 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Example 2-3

First, a thermal spray powder was produced in the same manner as in Example 1-3 except that the NiCr alloy powder, the solid lubricant material, and the aluminum powder were mixed so that the solid lubricant material: 4.5 mass %, the aluminum powder: 4 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Comparative Example 2

First, a thermal spray powder was produced in the same manner as in Comparative Example 1 except that the NiCr alloy powder, the solid lubricant material, and the aluminum powder were mixed so that the solid lubricant material: 4.5 mass %, the aluminum powder: 4 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Example 3-1

First, a thermal spray powder was produced in the same manner as in Example 1-1 except that the NiCr alloy powder, the solid lubricant material, and the aluminum powder were mixed so that the solid lubricant material: 4.5 mass %, the aluminum powder: 5 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Example 3-2

First, a thermal spray powder was produced in the same manner as in Example 1-2 except that the NiCr alloy powder, the solid lubricant material, and the aluminum powder were mixed so that the solid lubricant material: 4.5 mass %, the aluminum powder: 5 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Example 3-3

First, a thermal spray powder was produced in the same manner as in Example 1-3 except that so that the NiCr alloy powder, the solid lubricant material, and the aluminum powder were mixed so that the solid lubricant material: 4.5 mass %, the aluminum powder: 5 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Comparative Example 3

First, a thermal spray powder was produced in the same manner as in Comparative Example 1 except that the NiCr alloy powder, the solid lubricant material, and the aluminum powder were mixed so that the solid lubricant material: 4.5 mass %, the aluminum powder: 5 mass %, and the NiCr alloy powder: the remainder.

Next, in the same manner as in Example 1-1, a thermal spray test piece in which a thermal spray film was formed by thermally spraying the thermal spray powder on a surface of a substrate was produced.

Comparative Example 4

Figure 5B:
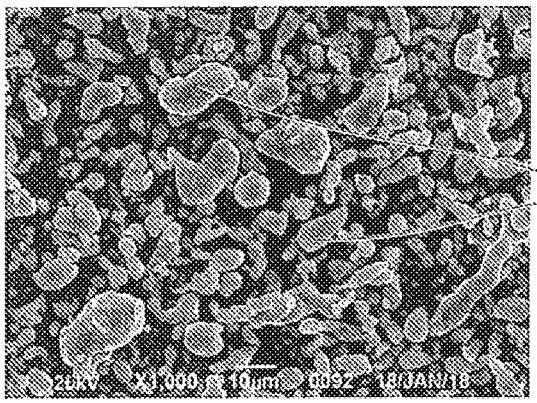
FIG. 5B shows an image obtained by observing aluminum particles contained in an aluminum powder in a comparative example under an SEM.

First, a thermal spray powder was produced in the same manner as in Example 1-1 except that an aluminum powder (#600F commercially available from Minalco Co., Ltd.) including aluminum particles having a particle size of 5 μm to 7 μm, and a content of oxygen of 0.37 mass % was prepared and the NiCr alloy powder, the solid lubricant material, and the aluminum powder were mixed so that the solid lubricant material: 4.5 mass %, the aluminum powder: 4 mass %, and the NiCr alloy powder: the remainder. Here, the particle size of aluminum particles indicates an equivalent spherical diameter. In addition, FIG. 5B shows an image obtained by observing aluminum particles contained in the aluminum powder in the comparative example under an SEM.

Next, in the same manner as in Example 1-1, a thermal spray test piece in which a thermal spray film was formed by thermally spraying the thermal spray powder on a surface of a substrate was produced.

Comparative Example 5

First, a thermal spray powder was produced in the same manner as in Comparative Example 4 except that the aluminum powder prepared in Comparative Example 4 was heated to prepare an aluminum powder including aluminum particles having a content of oxygen of 0.89 mass %.

Next, in the same manner as in Example 1-1, a thermal spray test piece in which a thermal spray film was formed by thermally spraying the thermal spray powder on a surface of a substrate was produced.

Comparative Example 6

First, a thermal spray powder was produced in the same manner as in Comparative Example 4 except that the aluminum powder prepared in Comparative Example 4 was heated to prepare an aluminum powder including aluminum particles having a content of oxygen of 3.8 mass %.

Next, in the same manner as in Example 1-1, a thermal spray test piece in which a thermal spray film was formed by thermally spraying the thermal spray powder on a surface of a substrate was produced.

Comparative Example 7

First, a thermal spray powder was produced in the same manner as in Comparative Example 4 except that the aluminum powder prepared in Comparative Example 4 was heated to prepare an aluminum powder including aluminum particles having a content of oxygen of 4.9 mass %.

Next, in the same manner as in Example 1-1, a thermal spray test piece in which a thermal spray film was formed by thermally spraying the thermal spray powder on a surface of a substrate was produced.

<Observation of Thermal Spray Powder Under SEM>

Figure 6A:
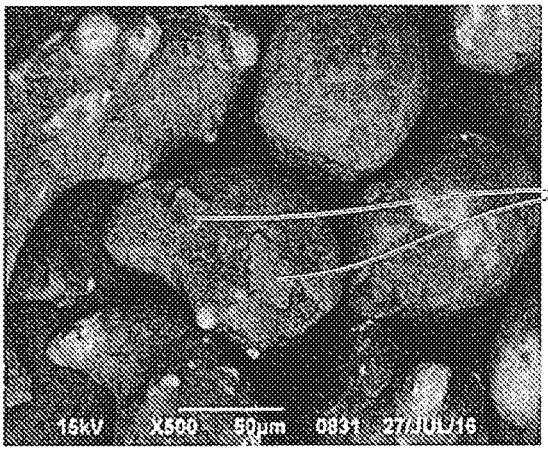
FIG. 6A shows an image obtained by observing a thermal spray powder in Example 2-3 under an SEM.

The thermal spray powders produced in the examples and the comparative examples were observed under an SEM. FIG. 6A shows an image obtained by observing the thermal spray powder of Example 2-3 under an SEM, and FIG. 6B shows an image obtained by observing the thermal spray powder of Comparative Example 4 under an SEM.

Figure 6B:
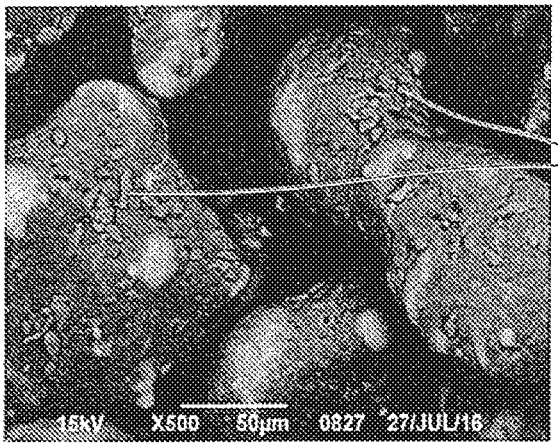
FIG. 6B shows an image obtained by observing a thermal spray powder in Comparative Example 4 under an SEM.

As shown in FIG. 6A and FIG. 6B, the coverage of aluminum flakes on the surfaces of Ni alloy particles contained in the thermal spray powder of Example 2-3 was larger than the coverage of aluminum particles on the surfaces of Ni alloy particles contained in the thermal spray powder of Comparative Example 4.

<Coverage of Aluminum on Surfaces of Ni Alloy Particles>

Regarding the thermal spray powders produced in the examples and the comparative examples, the coverage of aluminum (aluminum flakes or aluminum particles) on the surfaces of the Ni alloy particles was measured. Specifically, the thermal spray powder was observed under an SEM, image processing was performed, and the coverage was measured. The measurement results are shown in the following Table 1 together with the type of aluminum powder mixed into the thermal spray powder, the content of aluminum in the thermal spray powder, and the content of oxygen in aluminum.

TABLE 1

| | Type of aluminum powder | Content of aluminum in thermal spray powder [mass %] | Content of oxygen in aluminum [mass %] | Coverage of aluminum on surface of Ni alloy particle [%] |
|---|---|---|---|---|
| Example 1-1 | Aluminum flake | 3 | 0.29 | 60 |
| Example 1-2 | Aluminum flake | 3 | 0.94 | 60 |
| Example 1-3 | Aluminum flake | 3 | 4.1 | 60 |
| Comparative Example 1 | Aluminum flake | 3 | 5.0 | 60 |
| Example 2-1 | Aluminum flake | 4 | 0.29 | 80 |
| Example 2-2 | Aluminum flake | 4 | 0.94 | 80 |
| Example 2-3 | Aluminum flake | 4 | 4.1 | 80 |
| Comparative Example 2 | Aluminum flake | 4 | 5.0 | 80 |
| Example 3-1 | Aluminum flake | 5 | 0.29 | 100 |
| Example 3-2 | Aluminum flake | 5 | 0.94 | 100 |
| Example 3-3 | Aluminum flake | 5 | 4.1 | 100 |
| Comparative Example 3 | Aluminum flake | 5 | 5.0 | 100 |
| Comparative Example 4 | Aluminum particle | 4 | 0.37 | 20 |

TABLE 1-continued

| | Type of aluminum powder | Content of aluminum in thermal spray powder [mass %] | Content of oxygen in aluminum [mass %] | Coverage of aluminum on surface of Ni alloy particle [%] |
|---|---|---|---|---|
| Comparative Example 5 | Aluminum particle | 4 | 0.89 | 20 |
| Comparative Example 6 | Aluminum particle | 4 | 3.8 | 20 |
| Comparative Example 7 | Aluminum particle | 4 | 4.9 | 20 |

As shown in Table 1, in examples in which aluminum flakes were used as the aluminum powder mixed into the thermal spray powder, the coverage of aluminum was higher as the content of aluminum was higher. Specifically, when aluminum in a range of 3 mass % to 5 mass % was contained in the thermal spray powder, the coverage of aluminum was within a range of 60% to 100%. In addition, although the content of aluminum of Examples 2-1 to 2-3 in which aluminum flakes were used was 4 mass % the same as those of Comparative Examples 4 to 7 in which aluminum particles were used, the coverage of aluminum of Examples 2-1 to 2-3 was significantly higher than those of Comparative Examples 4 to 7.

<Oxygen Distribution in Cross Section of Thermal Spray Film>

Figure 7A:
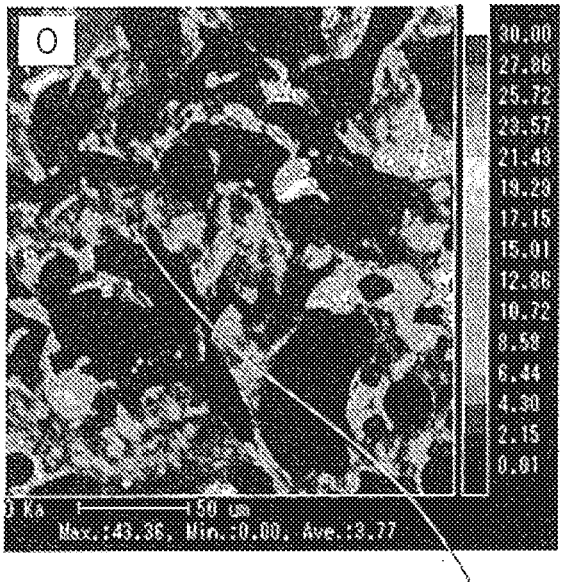
FIG. 7A is an image showing an oxygen distribution in the cross section of a thermal spray film of Example 2-3 analyzed by EPMA.

The oxygen distributions in the cross sections of the thermal spray films of the thermal spray test pieces produced in the examples and the comparative examples were analyzed by EPMA. FIG. 7A is an image showing an oxygen distribution in the cross section of the thermal spray film of Example 2-3 analyzed by EPMA, and FIG. 7B is an image showing an oxygen distribution in the cross section of the thermal spray film of Comparative Example 4 analyzed by EPMA.

Figure 7B:
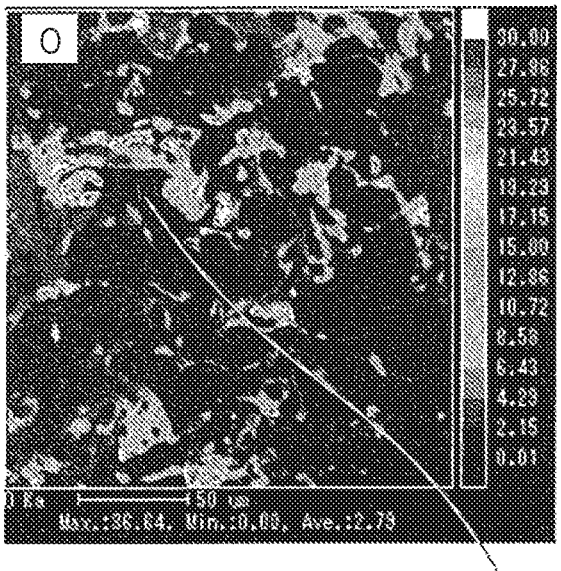
FIG. 7B is an image showing an oxygen distribution in the cross section of a thermal spray film of Comparative Example 4 analyzed by EPMA.

As shown in FIG. 7A and FIG. 7B, the content of oxygen present on the surface of Ni alloy particles in the cross section of the thermal spray film of Example 2-3 was larger than that in the cross section of the thermal spray film of Comparative Example 4.

<Peel Strength of Thermal Spray Film>

Figure 8A:
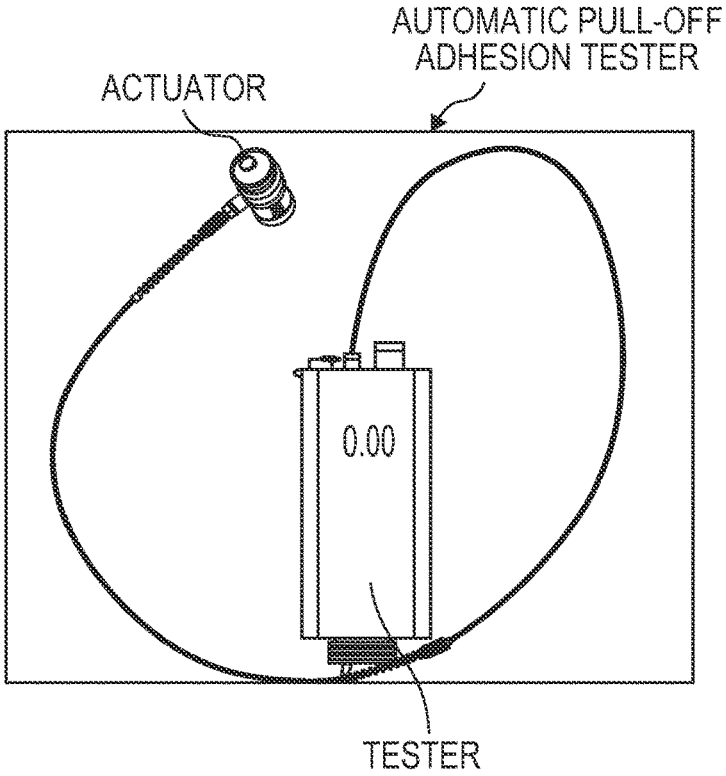
FIG. 8A shows a picture of an automatic pull-off adhesion tester (Elcometer510) used in a peeling test.
Figure 8B:
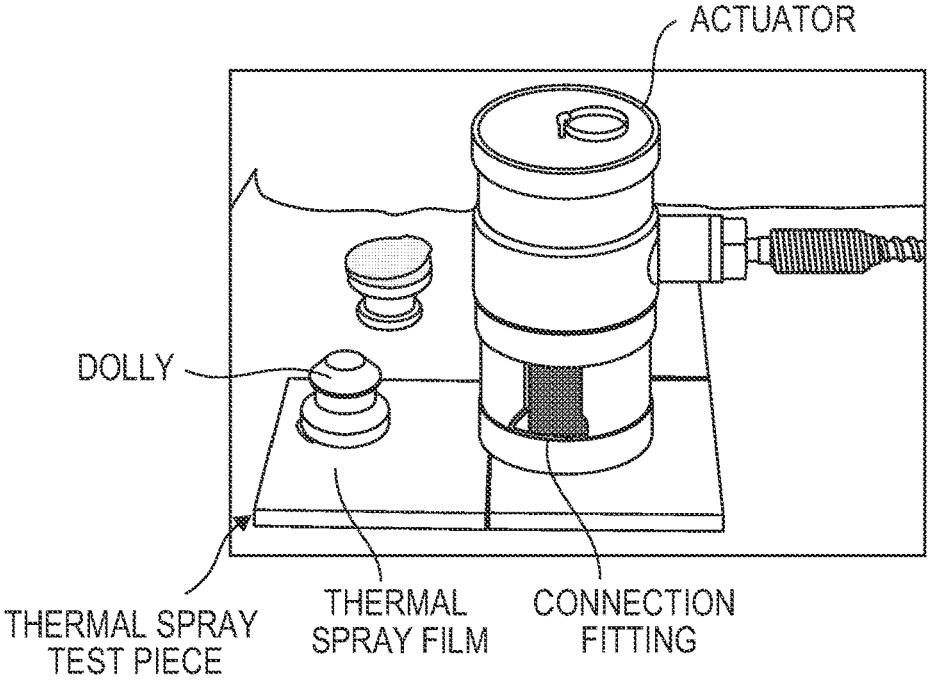
FIG. 8B shows a picture of an adhesion test using the automatic pull-off adhesion tester shown in FIG. 8A.

The thermal spray films of the thermal spray test pieces produced in the examples and the comparative examples were subjected to a peeling test in which the peel strength before and after a heat treatment in which the thermal spray test piece was left in an atmospheric furnace at 850° C. for 200 hours was evaluated. Here, FIG. 8A shows a picture of an automatic pull-off adhesion tester (Elcometer510) used in a peeling test, and FIG. 8B shows a picture of an adhesion test method using the automatic pull-off adhesion tester shown in FIG. 8A.

In the peeling test, first, shot blasting was performed on an adhesive surface of a dolly with a diameter of 20 mm, and 0.050 g to 0.060 g of a 2-component epoxy adhesive (Araldite (registered trademark) Standard) was then applied to the adhesive surface of the dolly, the adhesive surface of the dolly was adhered to the thermal spray film of the thermal spray test piece, and cured by being left at room temperature for 24 hours. Next, a connection fitting of the tester was pulled off and the actuator was placed on the dolly, and the connection fitting was then released and the dolly was fitted. Next, the tester was turned on, the diameter of the dolly, the measurement unit, and the pull-off speed were set to 20 mm, MPa, and 0.20 MPa/s. Then, the test start key of the tester was pressed to start the test.

After the test started, in the tester, since the pressure increased at a set pull-off speed until the dolly was peeled off from the thermal spray film, the pressure and peeling position when the dolly was peeled off form the thermal spray film were recorded. The peeling test was performed on two or more parts before and after a heat treatment of the thermal spray film of each thermal spray test piece, and the pressure and peeling position (at the interface of the substrate and the thermal spray film, in the thermal spray film, and on the adhesive surface) when the dolly was peeled off from the thermal spray film in the peeling test for the parts were recorded, and the average of pressures when the dolly was peeled off from the thermal spray film in the peeling test for the parts was obtained as the peel strength of the thermal spray film.

Figure 9:
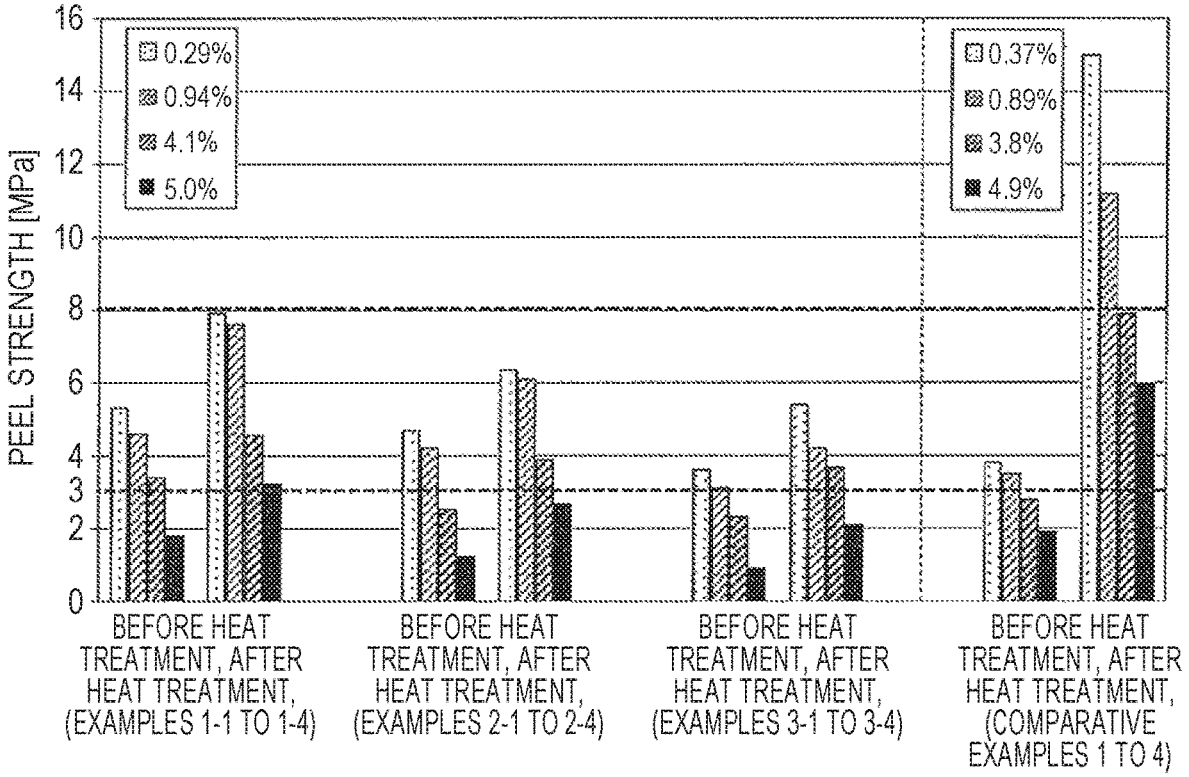
FIG. 9 is a graph showing the peel strength before and after a heat treatment on thermal spray films of thermal spray test pieces produced in examples and comparative examples.

FIG. 9 is a graph showing the peel strength before and after a heat treatment on thermal spray films of thermal spray test pieces produced in examples and comparative examples.

As shown in FIG. 9, in the thermal spray films of comparative examples in which aluminum particles were used as aluminum powders, the peel strength after the heat treatment was significantly larger than that before the heat treatment, and none of the peel strengths before and after the heat treatment was within a range of 3 MPa to 8 MPa. The reason for this is speculated to be as follows. First, in these thermal spray films, while aluminum particles were interposed between Ni alloy particles, the Ni alloy particles were directly fused to each other in most parts in which Ni alloy particles were connected to each other. Therefore, in the heat treatment, metal atoms diffused between Ni alloy particles in most of the connection parts, and sintering occurred, and thereby the bond strength between Ni alloy particles increased. As a result, it was thought that the above results were obtained.

On the other hand, among the thermal spray films of examples in which aluminum flakes were used as the aluminum powder, in the thermal spray film in which the content of oxygen in aluminum flakes was within a range of 0.29 mass % to 4.1 mass %, the peel strength after the heat treatment was within a range of 3 MPa to 8 MPa. Therefore, according to these thermal spray films, it was possible to secure erosion resistance and sufficient machinability after use under a high temperature environment, for example, in a turbocharger. The reason for this is speculated to be as follows. First, in these thermal spray films, in most parts in which Ni alloy particles were connected to each other, Ni alloy particles were fused to each other via the aluminum flakes. Therefore, in the heat treatment, oxygen contained in the aluminum flakes restricted diffusion of metal atoms between Ni alloy particles in most of the connection parts, and thus it was possible to curb the progress of sintering. Therefore, it was possible to minimize an increase in the bond strength between Ni alloy particles. As a result, it was considered that the peel strength after the heat treatment did not increase and the above results were obtained.

In addition, among these, in the thermal spray film in which the content of oxygen in aluminum flakes was within a range of 0.29 mass % to 0.94 mass %, the peel strength before the heat treatment was within a range of 3 MPa to 8 MPa. Therefore, according to these thermal spray films, it was possible to secure erosion resistance from when use started, for example, in a turbocharger. The reason for this is speculated to be as follows. First, in these thermal spray films, the content of oxygen in aluminum flakes was not too large, and thus diffusion of metal atoms between Ni alloy particles during film formation was not excessively restricted according to oxygen contained in the aluminum flakes. Therefore, fusion of Ni alloy particles progressed appropriately. As a result, it was thought that the above results were obtained without reducing the peel strength before the heat treatment.

While embodiments of the thermal spray powder of the present disclosure have been described above in detail, the present disclosure is not limited to the embodiments described above, and various design modifications can be made without departing from the spirit and scope of the present disclosure described in the claims.

What is claimed is:

1. A thermal spray powder which is used to form a thermal spray film having a characteristic of abradability, wherein the thermal spray powder includes Ni alloy particles, solid lubricant particles, and aluminum flakes, the content of oxygen in the aluminum flakes is within a range of 0.29 mass % to 4.1 mass %, and the coverage of aluminum flakes on the surfaces of the Ni alloy particles is within a range of 60% to 100%.

2. The thermal spray powder according to claim 1, wherein the content of oxygen in aluminum flakes is within a range of 0.29 mass % to 1 mass %.

* * * * *